US005577440A

United States Patent [19]

Marie

[11] Patent Number: 5,577,440

[45] Date of Patent: Nov. 26, 1996

[54] CONTAINER FOR STACKING NEWSPAPERS

[76] Inventor: Wendy L. Marie, 20071 Carson St., Santa Clarita, Calif. 91350

[21] Appl. No.: 590,938

[22] Filed: Jan. 24, 1996

[51] Int. Cl.[6] ..... B65B 27/08; B65B 13/18

[52] U.S. Cl. ..... 100/34; D6/475; 53/390; 53/592; 211/50; 220/4.33

[58] Field of Search ..... 100/1, 34; 211/50; D6/455, 475; 220/4.28, 4.33, 642, 692, 693; 53/390, 592

[56] References Cited

U.S. PATENT DOCUMENTS

| | | | |
|---|---|---|---|
| 305,508 | 9/1884 | Bulkeley | 100/34 |
| 1,246,923 | 11/1917 | Horrigan | 100/34 |
| 2,330,165 | 9/1943 | Wykes | 100/34 |
| 2,744,461 | 5/1956 | Genco | 100/34 |
| 2,964,210 | 12/1960 | Paley | 220/4.28 |
| 3,047,183 | 7/1962 | Papa | 220/4.33 |
| 3,572,535 | 3/1971 | Kinzie | 220/4.33 |
| 3,696,960 | 10/1972 | Smirle | 220/4.33 |
| 4,167,903 | 9/1979 | Lasher | 100/34 |
| 5,114,020 | 5/1992 | Martin | 100/34 |

FOREIGN PATENT DOCUMENTS

| | | | |
|---|---|---|---|
| 768709 | 8/1934 | France | 220/4.33 |
| 2510871 | 10/1975 | Germany | 100/34 |
| 3432732 | 3/1986 | Germany | 53/390 |
| 3837817 | 5/1990 | Germany | 100/34 |
| 5-294343 | 11/1993 | Japan | 220/4.33 |

*Primary Examiner*—Stephen F. Gerrity
*Attorney, Agent, or Firm*—Roger A. Marrs

[57] ABSTRACT

A container having opposite side walls or panels joined with opposite end walls or panels to provide an open box-like structure for insertably receiving a plurality of newspapers to form a disposable stack. Releasable fasteners are employed to detachably join the walls or panels together. A spool of binding string is removably carried on a selected end wall and string is trained in a cross-over pattern with string ends extending exteriorly thereof. The string passes through slotted apertures in the walls.

7 Claims, 1 Drawing Sheet

CONTAINER FOR STACKING NEWSPAPERS

BACKGROUND OF THE INVENTION

1. Field of the Invention

The present invention relates to the field of containers, and more particularly to a novel container employed for the stacking of newspapers and for binding the stack together after a sufficient number of papers has been stacked.

2. Brief Description of the Prior Art

It has been the conventional practice to bind newspapers together into a bundle. In this connection, the conventional practice has been to cross a pair of strings or tape on a flat surface followed by the stacking of newspapers over the inner section of the crossed strings or tapes and when a sufficient number of papers has been stacked, the ends of the strings are brought together about the sides and the ends of the stack and tied together to form a unitary bundle. In other situations, newspapers are inserted into a bag and when the bag is full, a tape or string is placed around the entire assemblage so that a bundle is provided. Further attempts have been made to provide a form or template into which newspapers may be placed followed by the securing of the papers into a stack.

Difficulties and problems have been encountered when employing the latter devices, which stem largely from the fact that such containers as boxes or the like are not susceptible for disassembly for storage in a flat condition when not in use or for transportation. Also, no means is provided for permitting the string to be predisposed and held in position preparatory for binding a stack of papers and for tying the strings to secure the bundle.

Therefore, a long-standing need has existed to provide a novel container for collecting a stack of newspapers which may be readily assembled for use and disassembled when not in use and which will predispose binding string or tape so that the string or tape is in a position to hold the stack in position and to secure the stack in that position.

Prior examples of paper stacking devices are found in U.S. Pat. Nos. 2,364,518; 4,993,318; 5,004,099 and 5,114,020. All these previous disclosures fail to solve the above-mentioned problems.

SUMMARY OF THE INVENTION

Accordingly, the above problems and difficulties are avoided by the present invention which provides a novel box-like structure having opposite sides and opposite end panels which are detachably connected together at their peripheral edges to provide a walled container having a top opening for insertably receiving papers intended to be stacked. The container may include a bottom for supporting the stack. A string or tape arrangement is provided which extends along the side panels and end panels and across the bottom in a prearranged geometric configuration so that papers inserted through the opening into the container will be aligned and rest on top of the tape or string arrangement. Means are provided on the end walls and side panels for training the tape or string therethrough and one end wall includes means for supporting a supply of tape or string in the form of a spindle or reel.

Therefore, a primary object of the present invention is to provide a novel open container into which newspapers may be placed for collection and stacking and which further includes a binding arrangement of strings or tapes that may secure the collected stack into a secure bundle.

Another object of the present invention is to provide a novel container for stacking newspapers which may be readily assembled into an operative position and disassembled into a flat storage or transportation position.

Another object of the present invention is to provide a novel container for stacking newspapers including means for detachably connecting the edge marginal regions of opposite side panels and end panels so that a detachable arrangement is produced permitting the container to be rapidly put together and taken apart without the use of tools or special knowledge.

Yet another object of the present invention is to provide a novel collecting system for newspapers which includes detachable end and side panels and which further includes a means for training binding string about a stack of collected papers in cooperation with apertures provided in the side and end panel.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
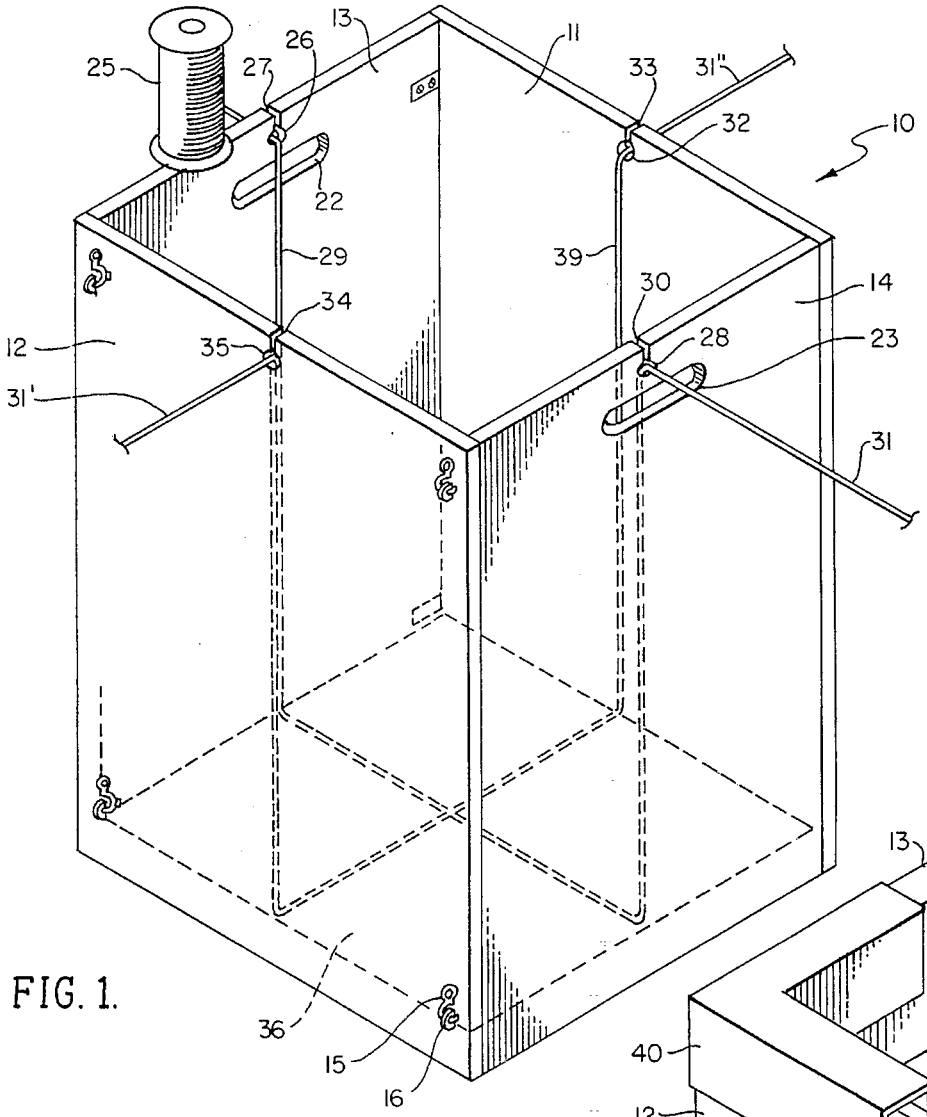
FIG. 1 is a front perspective view showing the novel container for stacking newspapers incorporating the present invention.

Referring to FIG. 1, the novel container for collecting newspapers is illustrated in the general direction of arrow 10 which includes sidewalls or panels 11 and 12 which are detachably joined together by opposite end walls or panels 13 and 14. Detachable means are employed for releasably connecting the panels together and such a detachable or releasable connector is indicates by hook 15 which is pivotally carried on the wall 12, for example, and is connected to a loop 16 which is carried on the wall 14 and projects through a slot for exposure beyond the surface of the wall or panel 12.

Figure 2:
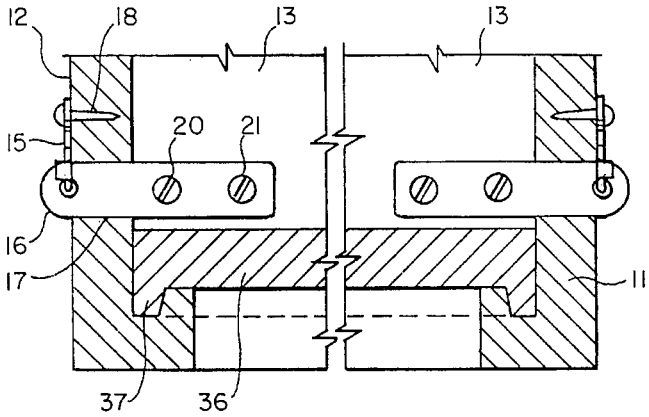
FIG. 2 is an enlarged sectional view showing means for detachably connecting adjacent edges of sidewall or panels and end panels.

FIG. 2 illustrates the connection and the slot is indicated by numeral 17. The hook 15 may be pivotally mounted on a nail or other pivot 18 while the loop or eyelet 16 may be attached to an end panel, such as panel 14 or 13, by screws 20 and 21 respectively.

The opposite end panels 13 and 14 may be provided with cutouts 22 and 23 to define hand grips in the event the user wishes to carry the apparatus or container from place to place. It can also be seen that a selected one of the end panels, such as panel 13, is provided with an upstanding rod over which a spool of thread of tape, as indicated by numeral 25, may be placed. The string, twine, thread or tape carried on the spool may be introduced to an opening 26 via a slot 27 so that a length of the string 29 may be trained on the inside surface of panel 13 and across the bottom of the container and up the inside surface of panel 14 where it may be passed through another aperture or opening 28. This can also be achieved through slot 30 in the edge marginal region of panel 14. A segment of the string, as indicated by numeral 31, may be extended exteriorly of the container. In a similar fashion, a length of string 39 may be placed into the aperture 32 in sidewall 11 by introducing the string through slot 33 where a length is passed downward along the inside surface of the sidewall 11 and across the bottom where the string is passed on the inside surface of sidewall 12 and through slot 34 into opening 35. If desired, a bottom panel 36 may be employed and, if desired, the bottom panel may be used to interlock the opposite side panels 11 and 12 together. Such an interlock is shown in FIG. 2 wherein the opposite sides of the bottom 36 are provided with flanges 37 that interlock with grooves provided in the lower end of each of the side panels 11 and 12. Also, the bottom may extend the flanges along the opposite ends which interlock with grooves provided in the lower end of the opposite end panels 13 and 14.

Figure 3:
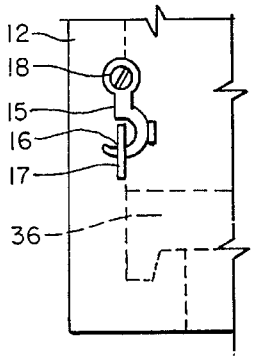
FIG. 3 is a side elevational view, greatly enlarged, of a means for detachably connecting the panels and walls together.

In FIGS. 2 and 3, the releasable latch mechanism is illustrated which includes the hook 15 that may be pivoted into a lock position, as shown in FIG. 3 where the hook is engaged with the eyelet 16. During disassembly, each of the respective hooks 15 are pivoted counterclockwise to remove the hook from the eyelets 16 and thereupon the walls and panels of the structure may be disconnected. Upon disconnection and disassembly, the panels may be stored in a flat manner for shipment or storage purposes.

Figure 4:
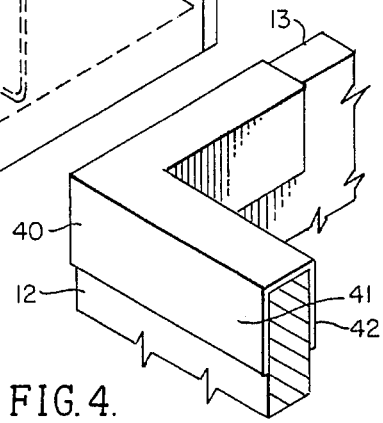
FIG. 4 is a fragmentary perspective view of another means for detachably connecting the adjacent edges of wall panels together.

Referring now in detail to FIG. 4, another means for interconnecting the side panels and end panels is represented by a clip 40 of L-shape in plan view. The clip 40 includes an internal channel defined between opposite side plates 41 and 42 so that the upper edge of the respective wall may be inserted into the channel. The clip 40 includes a first channel which will accommodate the corner of wall 12 with a second channel to accommodate the wall 13.

In actual practice, the end walls 13 and 14 are connected with the sidewalls 11 and 12 by means of the releasable fastener, as shown in FIG. 2, or as shown in FIG. 4 by the clip 40. The bottom panel 36 may be placed on the interior of the wall construction so that the continuous flange 37 can be inserted into a mating groove provided in the bottom of each of the respective panels 11–14 inclusive. While the panels are being assembled, the eyelets 16 may be aligned with slots 17 and pushed through to expose the eyelet for attachment by the hook 15. If the clip 40 is employed, the releasable pivoting hooks and eyelets are unnecessary. Once the wall panels have been attached, the length of string from spool 25 is trained through the interior of the container, as previously described. Papers can now be placed into the container on top of the string and when the papers have reached a given height, the length of string extending exteriorly of the container can be drawn through the slots 27, 28, 33 and 34 so that the extended string ends may be tied into a restraining knot. Once the tie and securement has been made, the stack of papers may be lifted through the opening of the container and after rethreading of string, the container can be used to accommodate an additional stack. If desired, the bottom 36 flanges 37 may be glued with a suitable adhesive to the respective grooves after mating.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A stacking container for collecting a plurality of newspapers comprising:

a pair of end panels;

a pair of side panels;

said side panels having opposite ends engaging with said end panels to provide a box-like structure;

releasable fastener means cooperatively carried on adjacent engaging side panels and end panels to detachably connect said side panels with said end panels whereby said side panels and said end panels disassemble from said box-like structure into a flat storage inoperative position and assemble into said box-like structure in an operative position;

said side panels and said end panels having a continuous upper edge marginal region defining an open entrance leading into the interior of said box-like structure;

each of said side panels and said end panels having a slotted opening communicating with said open entrance;

a first length of binding string trained longitudinally across said box-like structure through said slotted opening in each of said end panels;

a second length of binding string trained laterally across said box-like structure through said slotted opening in each of side side panels;

said first and said second lengths of binding string having a segment extending exteriorly of said box-like structure preparatory for binding newspapers collected within said box-like structure; and a spool carried on a selected one of said end panels at said upper edge marginal region for releasably holding a quantity of said binding string.

2. The invention as defined in claim 1 wherein:

said fastener means includes an eyelet secured to each of said end panels;

each of said side panels includes a slot for insertably receiving said eyelet from each of said end panels; and a hook pivotally carried on each of said side panels respectively and engageable with said eyelet to releasably secure said side panels with said end panels.

3. The invention as defined in claim 1 including:

a bottom panel removably disposed in said box-like structure in the interior thereof adjacent to a lower edge marginal region; and said first and said second binding strings trained across said bottom panel.

4. The invention as defined in claim 3 wherein:

said fastener means includes a wedge fitting between said lower edge marginal regions of said side panels and said end panels and said bottom; and a clip having a channel for insertably receiving said upper edge marginal region to releasably retain said side panels and said end panels together to provide said box-like structure.

5. The invention as defined in claim 4 wherein:

said lower edge marginal regions of said side panels and said end panels include a continuous groove opening into the interior of said box-like structure; and said bottom includes a peripheral region having a continuous downwardly depending wedge flange insertably receivable into said continuous groove.

6. The invention as defined in claim 5 including:

a cut-out in each of said end panels to provide a hand carrying grip for manual transportation of said box-like structure in said operative position.

7. The invention as defined in claim 6 wherein:

said box-like structure including said side panels and said end panels are adapted to be stacked on top of each other in a flat package in said operative position.

* * * * *